US006190765B1

(12) United States Patent
Idehara et al.

(10) Patent No.: US 6,190,765 B1
(45) Date of Patent: Feb. 20, 2001

(54) THERMAL TRANSFER SHEET

(75) Inventors: Tomoyuki Idehara; Keiji Hirose, both of Tokyo-to (JP)

(73) Assignee: Dai Nippon Printing Co., Ltd., Tokyo-to (JP)

( * ) Notice: Under 35 U.S.C. 154(b), the term of this patent shall be extended for 0 days.

(21) Appl. No.: 09/280,157

(22) Filed: Mar. 26, 1999

(30) Foreign Application Priority Data

Mar. 30, 1998 (JP) ..... P10-102185

(51) Int. Cl.[7] ..... B41M 5/40

(52) U.S. Cl. ..... 428/337; 428/195; 428/206; 428/423.1; 428/484; 428/913; 428/914

(58) Field of Search ..... 428/195, 206, 428/337, 423.1, 484, 913, 914

(56) References Cited

U.S. PATENT DOCUMENTS 5,902,667 * 5/1999 Stahl ..... 428/195

* cited by examiner

*Primary Examiner*—Bruce H. Hess
(74) *Attorney, Agent, or Firm*—Ladas & Parry

(57) ABSTRACT

A thermal transfer sheet of the present invention comprises a substrate, a primer layer and a heat fusible ink layer, the heat fusible ink layer being disposed on one side of the substrate via the primer layer containing at least fine particles of urethane resin at an amount in a range of 10 to 60% by weight. The thermal transfer sheet is improved in retentivity of the substrate for the heat fusible ink layer and transfer sensitivity of the heat fusible ink layer as well as quality of print and resistances to solvent and friction.

6 Claims, 1 Drawing Sheet

THERMAL TRANSFER SHEET

BACKGROUND OF THE INVENTION

1. Field of the Invention

The present invention relates to a thermal transfer sheet and in particular to a thermal transfer sheet excellent in retentivity of a heat fusible ink layer and transfer properties.

2. Description of the Related Art

In recent years, thermal transfer sheets utilizing a heat fusion transfer system are used for output print etc. of a computer, word processor etc. Generally, thermal transfer sheets utilizing a heat fusion transfer system are those in which a polyethylene terephthalate film of 3 to 20 μm in thickness is used as the substrate and a heat fusible ink having a coloring agent dispersed in a binder is applied onto the substrate to form a heat fusible ink layer.

Conventional thermal transfer sheets include those using resin or wax as the binder of a heat fusible ink layer. The thermal transfer sheet provided with a heat fusible ink layer using resin as the binder is excellent in the adhesion properties (retentivity) of the heat fusible ink layer on the substrate, and the printed images formed have high friction resistance, but there are disadvantages of a poor transfer sensitivity, an inadequate compatibility with rough paper and a poor solvent resistance of printed images. On the other hand, the thermal transfer sheet provided with a heat fusible ink layer using wax as the binder is excellent in transfer sensitivity, can form good printed images on a rough paper and is excellent in the solvent resistance of printed images, but there are disadvantages of a poor retentivity of the heat fusible ink layer on the substrate and a low friction resistance of printed images.

Among the problems described above, the problem of retentivity can be solved by forming a primer layer between the substrate and the heat fusible ink layer to improve the adhesion properties therebetween, but in any cases where resin or wax is used as the binder, there are problems inherent in the material.

Accordingly, a thermal transfer sheet using both resin and wax as the binder to compensate for the disadvantages of both of them has been developed. For example, a thermal transfer sheet provided with a heat fusible ink layer using a petroleum resin as the resin and carnauba wax as the wax is used.

Even if both resin and wax are simultaneously used as the binder, the retentivity of the heat fusible ink layer on the substrate disagrees with the transfer sensitivity of the heat fusible ink layer, and therefore it is conceivable that the transfer sensitivity of the heat fusible ink layer is set at adequate levels and then a primer layer is formed between the substrate and the heat fusible ink layer in order to improve retentivity. However, the primer layer used heretofore suffers from the problem that the retentivity of the heat fusible ink layer using resin and wax as the binder cannot be raised to adequate levels for the substrate.

Further, it should be taken into consideration that sound upon detachment at the time of printing does not becomes too high in improving retentivity.

SUMMARY OF THE INVENTION

This invention has been achieved under these circumstances, and the object of this invention is to provide a thermal transfer sheet which is excellent both in retentivity and in transfer sensitivity, with sound upon detachment at the time of printing being suppressed within the optimum range.

To attain this object, the present invention is constituted so as to be provided with a heat fusible ink layer disposed on one side of a substrate via a primer layer, said primer layer containing at least fine particles of urethane resin at an amount in a range of from 10% by weight to 60% by weight.

Further, the thermal transfer sheet of the present invention is constituted such that said primer layer contains fine particles of wax along with fine particles of urethane resin.

Further, the thermal transfer sheet of the present invention is constituted such that the fine particles of urethane resin have a means particle size in the range of 0.05 to 5 μm.

Further, the thermal transfer sheet of the present invention is constituted such that the fine particles of urethane resin have a glass transition temperature in the range of −50 to 50° C.

In the present invention as described above, the fine particles of urethane resin contained in the primer layer permits the substrate and the heat fusible ink layer to be bonded in conditions near to point adhesion, thus improving retentivity, and by said constitution, the cohesive failure of the primer layer at the time of thermal transfer is promoted to bring about the effect of improving transfer sensitivity even with a less amount of energy. Further, by incorporating a suitable amount of the fine particles of urethane resin into the primer layer, there is also brought about the effect of permitting sound upon detachment at the time of printing to be suppressed in the optimum range.

DETAILED DESCRIPTION OF THE PREFERRED EMBODIMENTS

Figure 1:
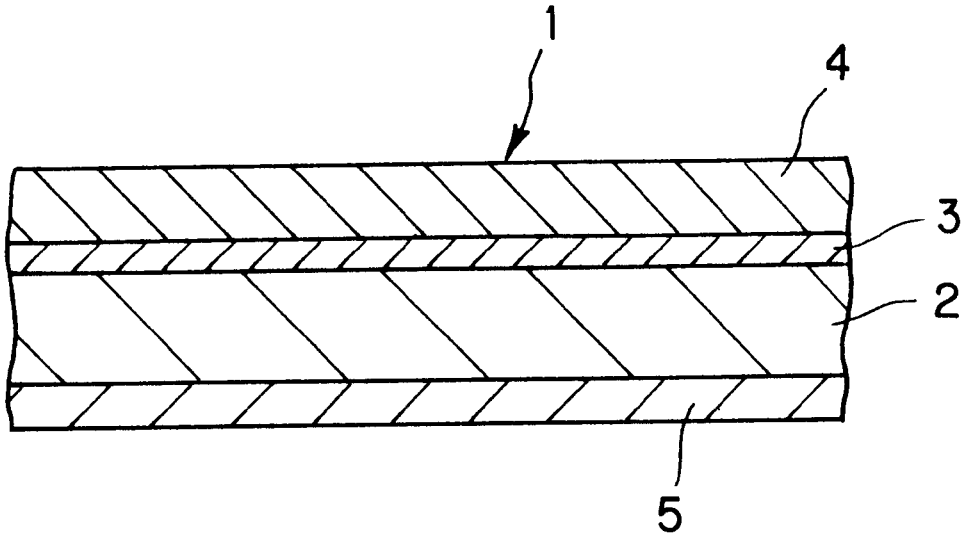
FIG. 1 is a sectional view showing one example of the thermal transfer sheet of the present invention.

FIG. 1 is a sectional view showing one example of the thermal transfer sheet of the invention. In FIG. 1, the thermal transfer sheet 1 of the invention is provided with the substrate 2, the heat fusible ink layer 4 formed on one side of said substrate 2 via the primer layer 3, and the back surface layer 5 formed on the other side of the substrate 2.

The substrate 2 constituting the thermal transfer sheet 1 of the present invention can make use of any substrate used in conventional transfer sheets and are not particularly limited. As the substrate, there may be used: plastic films made of, for example, polyester, polypropylene, cellophane, polycarbonate, cellulose acetate, polyethylene, polyvinyl chloride, polystyrene, nylon, polyimide, polyvinylidene chloride, polyvinyl alcohol, fluorine resin, chlorinated rubber, ionomer or the like; papers such as glassine paper, condenser paper, paraffin paper or the like; and nonwoven fabric etc. Further, their composite can also be used as substrate 2.

The thickness of said substrate 2 can be suitably determined so as to achieve required strength and thermal conductivity, and for example it may be 1 to 100 μm or so.

The primer layer 3 constituting the thermal transfer sheet 1 of the present invention is a layer by which the retentivity (adhesion properties) of the heat fusible ink layer 4 for the substrate 2 can keep stable conditions, and simultaneously the heat fusible ink layer 4 in a region heated by a thermal head at the time of heat transfer can be easily and reliably transferred to an receiving material. The primer layer 3 is to contain at least fine particles of urethane resin. The substrate 2 and the heat fusible ink layer 4 can be bonded in conditions near to point adhesion by the fine particles of urethane resin.

That is, it is considered that the substrate 2 and the heat fusible ink layer 4 comes into points contact with each other via the primer layer 3, and that the heat fusible ink layer 4 is fixed to the substrate 2 by bonding almost at contacting points.

The fine particles of urethane resin to constitute the primer layer 3 usually have a mean particle size within the range of 0.05 to 5 $\mu$m, preferably 0.1 to 2 $\mu$m and its glass transition point is usually within the range of −50 to 50° C., preferably 0 to −35° C. If the mean particle size of the fine particles of urethane resin is less than 0.05 $\mu$m, the point adhesion between the substrate 2 and the heat fusible ink layer 4 may be difficult to make the improvement of retentivity and transfer sensitivity impossible, while an average particle diameter of more than 5 $\mu$m is not preferable either because the surface of transferred printed images may cause a sense of mat. Further, if the glass transition temperature of the fine particles of urethane resin is less than −50° C., the transfer sensitivity and film-cutting properties of the heat fusible ink layer 4 may be deteriorated, while in the case of more than 50° C., retentivity may become inadequate. The content of such fine particles of urethane resin in the primer layer 3 is preferably in the range of 10 to 60% by weight, and if the content is less than 10% by weight, retentivity may become inadequate. If the content exceeds 60% by weight, sound upon detachment tends to be high.

Further, the primer layer containing 10 to 60% by weight of fine particles of urethane resin is provided between the substrate 2 and the heat fusible ink layer 4 whereby the cohesive failure in the primer layer is promoted at the time of transfer, while the substrate 2 and the heat fusible ink layer 4 are bonded in a good state of point adhesion, and the reduction of sound upon detachment can be made feasible.

Further, the primer layer 3 may contain fine particles of wax or acrylic resin along with fine particles of urethane resin. In this case, the proportion of the fine particles of urethane resin: other fine particles such as wax fine particles in the primer layer 3 can be set in the range of 10:90 to 90:10 in ratio by weight of solid contents. The fine particles of wax to be used may be composed of that used in conventional thermal transfer sheets and there may be exemplified fine particles of: microcrystalline wax, carnauba wax, paraffin wax, Fischer-Tropsch wax, various low-molecular polyethylenes, Japan wax, beeswax, spermaceti, insect wax, wool wax, shellac wax, candelilla wax, petrolatum, polyester wax, partially modified wax, fatty esters, fatty amides or the like. The mean particle size of such fine particles of wax is preferably in the range of 0.1 to 2 $\mu$m.

The primer layer 3 described above may be formed by adding additives, as required, to an aqueous emulsion of urethane resin or to a mixture of an aqueous emulsion of urethane resin and an aqueous emulsion of wax and then applying and drying the resulting mixture on the substrate 2 in a method known in the art. The amount of the coating liquid to be applied for forming the primer layer 3 is preferably 0.1 to 1 g/m$^2$ in terms of the solid content.

The heat fusible ink layer 4 constituting the thermal transfer sheet 1 of the invention composed of at least a coloring agent and a binder and may additionally contain inorganic materials such as fine metal particles, calcium carbonate, glass frit etc. and further contain various additives as required.

As the coloring agent used in the heat fusible ink layer 4, it is preferab to use carbon black or metal pigments for black single-color printing, while use chromatic pigments such as yellow, magenta, cyan etc. for multi-color printing. In the case of multi-color printing, a yellow ink layer, a magenta ink layer and a cyan ink layer can be formed side by side in this order on the surface. The amount of these pigments used is usually in the range of about 1 to 80% by weight, preferably about 5 to 25% by weight in the heat fusible ink layer 4.

As the binder, resin alone, wax alone or a combination of resin and wax can be used, and if necessary a mixture of drying oil, resin, mineral oil, cellulose and rubber derivatives etc. may be used.

Examples of such binders include linear low-density polyethylene, low-density polyethylene, medium-density polyethylene, high-density polyethylene, polypropylene resin, ethylene-vinyl acetate copolymer, polyester resin, polyamide resin, ionomer resin, ethylene-acrylate resin, styrene-butadiene copolymer, acrylonitrile-butadiene copolymer, polystyrene resin, petroleum resin or the like.

Examples of wax as the binder include those described above as wax usable for the primer layer 3.

If resin and wax are used in combination as the binder, the content of the resin in the heat fusible ink layer 4 is usually in the range of about 1 to 90% by weight, preferably about 20 to 80% by weight, and the content of wax therein is usually in the range of about 1 to 70% by weight, preferably about 2 to 20% by weight.

Examples of the method for forming the heat fusible ink layer 4 on the primer layer 3 provided on the substrate 2 are hot melt coating, hot lacquer coating, gravure coating, gravure reverse coating, roll coating, emulsion coating, and other method known in the art. The thickness of the heat fusible ink layer 4 formed in this manner is preferably about 0.5 to 20 $\mu$m.

The back surface layer 5 is formed in order to improve the smoothness of a thermal head and to prevent sticking. Such back surface layer 5 is formed from the binder and other necessary additives. Examples of the binder to be used in the back surface layer include: cellulose resins such as ethyl cellulose, hydroxyethyl cellulose, hydroxypropyl cellulose, methyl cellulose, cellulose acetate, cellulose acetate butyrate, and nitrocellulose; vinyl resins such as polyvinyl alcohol, polyvinyl acetate, polyvinyl butyral, polyvinyl acetal, polyvinyl pyrrolidone, acrylic resin, polyacrylamide, and acrylonitrile-styrene copolymer; polyester resin; polyurethane resin; silicone-modified or fluorine-modified urethane resin or the like. Among these, those having some reactive groups such as hydroxyl group are preferably used in combination with polyisocyanate etc. as a crosslinking agent to form a crosslinked resin layer. Other additives such as antistatic agent etc. may be added to the back surface layer 5 as required.

The thermal transfer sheet of the present invention is not limited to the examples described above. For example, a surface layer may be formed on the heat fusible ink layer 4 to enable excellent transfer to an uneven receiving material (e.g. rough paper etc.) and to prevent the occurrence of blocking in a rolled form.

Such a surface layer may be the same as the surface layer formed in conventional thermal transfer sheets, but is preferably a layer composed of both an adhesive resin and a resin having releasing ability. In this case, the adhesive resin can make use of thermoplastic resin with a relatively low melting point. Specific examples include ethylene-vinyl acetate copolymer, ethylene-acrylate copolymers, polybutene, petroleum resin, vinyl chloride-vinyl acetate copolymer, polyvinyl acetate or the like, and it is preferable to use a resin having a melting viscosity higher than that of the binder used in forming the heat fusible ink layer 4 described above. Further, the resin having releasing ability can make use of silicone resin. As the silicone resin, mention there may be exemplified silicone-modified acrylic resin, silicone-modified urethane resin, silicone-modified epoxy resin, silicone-modified urea resin or the like.

The proportion of the adhesive resin:the resin having releasing ability in the surface layer (adhesive resin:resin having releasing ability) is preferably in the range of from 10:0.1 to 10:20 in ratio by solid content. Further, other additives such as antistatic agent etc. may be added to the surface layer as required. The thickness of the surface layer is preferably about 0.1 to 5 μm.

As described above in detail, the thermal transfer sheet according to the present invention is constituted by forming a heat fusible ink layer on one side of a substrate via a primer layer containing at least fine particles of urethane resin, so the substrate and the heat fusible ink layer are bonded via the fine particles of urethane resin interposed therebetween, thereby making a bonded condition near to point adhesion. According to such a constitution, any heat fusible ink layers using resin only, wax only, or a combination of resin and wax as the binder are excellent in retentivity and simultaneously improve heat transfer sensitivity with a less amount of energy required for the transfer of the heat fusible ink layer, and further when the thermal transfer sheet is provided with a heat fusible ink layer using a combination of resin and wax as the binder, it is particularly capable of forming excellent printed images on rough paper and providing the printed images high in solvent resistance and friction resistant.

EXAMPLE

Hereinafter, the present invention is described in more detail by reference to the Examples.

First, an aqueous emulsion (Adecabon Titer HUX-290H, Asahi Denka Kogyo Corporation) containing fine particles of urethane resin having a mean particle size of 2 μm and a glass transition temperature of −23° C. and an aqueous emulsion containing fine particles of carnauba wax having a mean particle size of 0.3 μm were mixed in the following solid content proportion, and this mixture was applied by roll coating, in applied amount of 0.6 g/m$^2$ (solid content) onto a polyethylene terephthalate (PET) film of 4.5 μm in thickness and dried (60° C.) to form primer layers (samples A to D).

Solid Content Proportion in Samples A to D
(fine particles of urethane resin:carnauba wax)

Sample A=50:50

Sample B=20:80

Sample C=10:90

Sample D=5:95

Further, the above mentioned aqueous emulsion containing the fine particles of urethane resin was applied by gravure coating, in an applied amount of 0.6 g/m$^2$ (solid content), onto a polyethylene terephthalate (PET) film of 4.5 μm in thickness and dried (60° C.) to form a primer layer (sample E).

For comparison, an aqueous emulsion (Chemipearl V300, Mitsui Petrochemical Industries, Co. Ltd.) containing fine particles of ethylene-vinyl acetate copolymer having a mean particle size of 6 μm and a glass transition temperature of −23 to −30° C. was applied by roll coating, in applied amount of 0.6 g/m$^2$ (solid content) onto a polyethylene terephthalate (PET) film of 4.5 μm in thickness and dried (60° C.) to form a primer layer (sample F).

Further, for comparison, an aqueous emulsion containing fine particles of carnauba wax having a mean particle size of 0.3 μm was applied by roll coating, in applied amount of 0.6 g/m$^2$ (solid content) onto a polyethylene terephthalate (PET) film of 4.5 μm in thickness and dried (60° C.) to form a primer layer (sample G).

Further, as comparison, a primer layer ink incorporating carnauba wax and styrene-butadiene rubber (SBR) in a ratio (carnauba wax:SBR) of 50:50 (solid content) was applied by roll coating, in applied amount of 0.6 g/m$^2$ (solid content) onto a polyethylene terephthalate (PET) film of 4.5 μm in thickness and dried (60° C.) to form a primer layer (sample H).

Then, three heat fusible inks each having the composition shown below were applied respectively, in an amount of 1.0 to 3.0 g/m$^2$ (solid content), onto the primer layers (samples A to H) formed as described above and then dried (80° C.) to form heat fusible ink layers. Then, an ink of the back surface layer having the composition shown below was applied, in an applied amount of 0.15 g/m$^2$ (solid content) by the roll coating, onto the back of each substrate whereby heat transfer sheets (A-1 to A-3, B-1 to B-3, C-1 to C-3, D-1 to D-3, E-1 to E-3, F-1 to F-3, G-1 to G-3, and H-1 to H-3) were obtained.

| | |
|---|---|
| <Composition of Heat Fusible Ink 1 (ratio by solid content)> | |
| Carbon black (#25, Mitsubishi Chemical Industries Co., Ltd.): | 20 parts by weight |
| Carnauba wax: | 40 parts by weight |
| Paraffin wax (HNP-11, Nippon Seiro Co., Ltd.): | 35 parts by weight |
| <Composition of Heat Fusible Ink 2 (ratio by solid content)> | |
| Carbon black (#25, Mitsubishi Chemical Industries Co., Ltd.): | 20 parts by weight |
| Petroleum resin (Quintone 1925, Nippon Zeon Co., Ltd.): | 75 parts by weight |
| <Composition of Heat Fusible Ink 3 (ratio by solid content)> | |
| Carbon black (#25, Mitsubishi Chemical Industries Co., Ltd.): | 20 parts by weight |
| Petroleum resin (Quintone 1925, Nippon Zeon Co., Ltd.): | 20 parts by weight |
| Carnauba wax | :55 parts by weight |
| <Composition of Back Surface Layer Ink) | |
| Silicon-modified urethane resin: | 10 parts by weight |
| Polyisocyanate: | 5 parts by weight |
| Methyl ethyl ketone/toluene (1/1): | 85 parts by weight |

Each of the thermal transfer sheets (samples A-1 to A-3, B-1 to B-3, C-1 to C-3, D-1 to D-3, E-1 to E-3, F-1 to F-3, G-1 to G-3, and H-1 to H-3) prepared as described above were evaluated for retentivity in the following manner, and the results are shown in Table 1.

<Method of Evaluating Retentivity>

A strip-shaped sample was prepared from each thermal transfer sheet and this sample was drawn by a cutter knife under a loading of 50 g at a constant rate(speed) and evaluated according to the following evaluation criteria by a visual observation.

Evaluation Criteria

○: The heat fusible ink layer does not become loose from the sublayer or the substrate.

Δ: The heat fusible ink layer becomes loose from the sublayer or the substrate.

X: The heat fusible ink layer is removed from the sublayer or the substrate.

Further, each thermal transfer sheet was printed in the following printing conditions, and its transfer properties and friction resistance were evaluated. The results are shown in Table 1 below.

<Printing Conditions>

Printing unit: ZEBRA-140

Printing speed: 2 mm/sec.

Material subjected to printing: Label (FASSON 1C)

<Method of Evaluating Transfer Properties>

The printing energy was changed from the minimum energy to the maximum energy to perform printing, and transfer properties were evaluated according to the following evaluation criteria by a visual observation.

Evaluation Criteria

○: Transfer properties are good from the start to the end of printing.

Δ: Transfer properties are bad at the portion where printing was started, but are within practical levels.

X: Transfer properties are bad as a whole from the start to the end of printing, and there occurred an undesirable transfer to adjacencies of a regular printed portion, missing and the like.

<Method of Evaluating Friction Resistance>

The printed material was set at a vibration tester (Suga Shikenki Corporation) and rubbed 300 times with an abrading material under a loading of 500 g and evaluated according to the following evaluation criteria by a visual observation.

Evaluation Criteria

○: The transferred printed images are not changed.

Δ: The transferred printed images are partially removed but are within practical levels.

X: The transferred printed images are significantly removed.

<Method of Evaluating Sound upon Detachment)

Each thermal transfer sheet was printed at the same printing energy in the printing conditions adapted for the above described evaluation of transfer properties, and sound upon detachment was evaluated by the use of RION NL-05A (Lp) (Manufactured by Rion Corporation) according to the following conditions and criteria.

<Conditions>

Frequency correction characteristics: flat

Single noise exposure level (E): dB

Dynamic characteristics: FAST

Measurement distance: 1.5 cm in a horizontal direction from the printed portion.

Evaluation Criteria

When the single noise exposure level (E) was at 100 dB or more, it was given "No Good (NG)".

TABLE 1

| | Primary Layer | Heat Fusible Ink Layer | Reten-tivity | Transfer Property | Friction Resistance | Sound upon Detachment |
|---|---|---|---|---|---|---|
| | | | Sample | | | |
| A-1 | A | 1 | ○ | ○ | ○ | 96 |
| A-2 | A | 2 | ○ | ○ | ○ | 97 |
| A-3 | A | 3 | ○ | ○ | ○ | 96 |
| B-1 | B | 1 | ○ | ○ | ○ | 95 |
| B-2 | B | 2 | ○ | ○ | ○ | 97 |
| B-3 | B | 3 | ○ | ○ | ○ | 94 |
| C-1 | C | 1 | ○ | ○ | ○ | 96 |
| C-2 | C | 2 | ○ | ○ | ○ | 95 |
| C-3 | C | 3 | ○ | ○ | ○ | 95 |
| | | | Comparison | | | |
| D-1 | D | 1 | X | Δ | ○ | 94 |
| D-2 | D | 2 | X | Δ | ○ | 95 |
| D-3 | D | 3 | X | Δ | ○ | 94 |
| E-1 | E | 1 | ○ | Δ | ○ | 103 |
| E-2 | E | 2 | ○ | Δ | ○ | 105 |
| E-3 | E | 3 | ○ | Δ | ○ | 106 |

TABLE 1-continued

| | Primary Layer | Heat Fusible Ink Layer | Reten-tivity | Transfer Property | Friction Resistance | Sound upon Detachment |
|---|---|---|---|---|---|---|
| F-1 | F | 1 | Δ | Δ | X | 95 |
| F-2 | F | 2 | Δ | Δ | X | 96 |
| F-3 | F | 3 | X | X | X | 96 |
| G-1 | G | 1 | Δ | Δ | ○ | 94 |
| G-2 | G | 2 | Δ | Δ | ○ | 95 |
| G-3 | G | 3 | X | X | ○ | 95 |
| H-1 | H | 1 | ○ | ○ | ○ | 105 |
| H-2 | H | 2 | ○ | ○ | ○ | 103 |
| H-3 | H | 3 | ○ | ○ | ○ | 106 |

As shown in Table 1, any of the thermal transfer sheets of the present invention (samples A-1 to A-3, B-1 to B-3, and C-1 to C-3), that is, the samples (samples A-1, B-1 and C-1) provided with a heat fusible ink layer using only wax as the binder, the samples (samples A-2, B-2 and C-2) provided with a heat fusible ink layer using only resin, and the samples (samples A-3, B-3 and C-3) provided with a heat fusible ink layer using both wax and resin were excellent in the retentivity of the heat fusible ink layer. It was further confirmed that any of the thermal transfer sheets of the present invention (samples A-1 to A-3, B-1 to B-3 and C-1 to C-3) were excellent in transfer properties, the friction resistance of the printed images and silence level of sound upon detachment.

As opposed to these sheets, the thermal transfer sheets (D-1 to D-3) had an insufficient content of fine particles of urethane resin and were inferior in the retentivity of the fusible ink layer.

Thermal transfer sheets (E-1 to E-3) had an excessive content of fine particles of urethane resin, and were noisy at the detachment.

The thermal transfer sheets for comparison (F-1 to F-3 and G-1 to G-3) showed variations in retentivity depending on the combination of the primer layer and the heat fusible ink layer, and the samples (samples F-3 and G-3) provided with a heat fusible ink layer using both wax and resin were poor in the retentivity of the heat fusible ink layer.

The thermal transfer sheets for comparison (H-1 to H-3) were noisy at the detachment.

What is claimed is:

1. A thermal transfer sheet comprising a substrate, a primer layer and a heat fusible ink layer, the heat fusible ink layer being disposed on one side of the substrate via the primer layer, wherein the primer layer contains at least fine particles of urethane resin at an amount in a range of from 10% by weight to 60% by weight.

2. A thermal transfer sheet as claimed in claim 1, wherein said fine particles of urethane resin have a mean particle size in a range of 0.05 to 5 $\mu$m.

3. A thermal transfer sheet as claimed in claim 1, wherein said fine particles of urethane resin have a glass transition temperature in a range of −50 to 50° C.

4. A thermal transfer sheet as claimed in claim 1, wherein said primer layer contains the fine particles of urethane resin at an amount effective in improving retentivity of the heat fusible ink layer for the substrate.

5. A thermal transfer sheet as claimed in claim 1, wherein said primer layer further contains fine particles of wax.

6. A thermal transfer sheet as claimed in claim 5, wherein an amount ratio of said fine particles of urethane resin and said fine particles of wax (urethane: wax) is in a range of 10:90 to 90:10 by weight.

* * * * *